US006796352B1

(12) United States Patent
Geurtsen et al.

(10) Patent No.: US 6,796,352 B1
(45) Date of Patent: Sep. 28, 2004

(54) APPARATUS FOR APPLYING HEAT-TRANSFER LABELS ONTO OBJECTS

(76) Inventors: John W. Geurtsen, 286 Chamberlain Rd., Holliston, MA (US) 01746; Friedrich H. H. Geurtsen, 407 Winter St., Holliston, MA (US) 01746; Paul C. Croci, 21 Break Neck Hill Rd., Southboro, MA (US) 01772

( * ) Notice: Subject to any disclaimer, the term of this patent is extended or adjusted under 35 U.S.C. 154(b) by 13 days.

(21) Appl. No.: 09/634,204

(22) Filed: Aug. 9, 2000

(51) Int. Cl.[7] ..... B65C 3/08; B65C 3/16; B65C 9/24; B65C 11/06

(52) U.S. Cl. ..... 156/446; 156/443; 156/556; 156/566; 156/567; 156/DIG. 11; 156/DIG. 13

(58) Field of Search ..... 156/443, 445–448, 156/456, 566–568, DIG. 11–13, DIG. 25–26, DIG. 36–37, DIG. 42, DIG. 51, 540, 541, 542, DIG. 28, DIG. 33, 556

(56) References Cited

U.S. PATENT DOCUMENTS 3,709,755 A * 1/1973 Wochner ..... 156/235
4,840,694 A * 6/1989 Brookman et al. ..... 156/344
5,188,696 A * 2/1993 Good, Jr. ..... 156/361
5,250,129 A * 10/1993 Twele ..... 156/235
5,281,296 A 1/1994 Beliveau
5,650,028 A * 7/1997 Brandt et al. ..... 156/238
5,650,037 A 7/1997 Larson
5,735,996 A * 4/1998 Asghar et al. ..... 156/448
5,817,210 A * 10/1998 Morin ..... 156/583.1
5,824,176 A 10/1998 Stein et al.
5,988,251 A * 11/1999 Hunt et al. ..... 156/539
6,006,808 A * 12/1999 Ewert et al. ..... 156/556
6,098,689 A * 8/2000 Fiwek ..... 156/540
6,379,761 B1 * 4/2002 Brandt et al. ..... 428/35.7
6,402,868 B1 * 6/2002 Tagawa et al. ..... 156/157

* cited by examiner

*Primary Examiner*—Sue A. Purvis
(74) *Attorney, Agent, or Firm*—Kriegsman & Kriegsman

(57) ABSTRACT

An apparatus for decorating an object with the heat-transfer label of a heat-transfer label assembly includes a decorating unit for applying the heat-transfer label onto the object during an extended period of decoration a conveying mechanism for continuously, rotationally advancing and supporting the object during the extended period of decoration. The decorating unit includes a preheater for heating the heat-transfer label assembly before the period of decoration, a generally flat, heated contact plate which is adapted to pivot so as to continuously urge the heat-transfer label into contact with the object throughout the extended period of decoration and a transport assembly for advancing the heat-transfer label assembly from the preheater to the heated contact plate. The heated contact plate includes a rubber layer constructed of an 80 durometer silicone and a 0.10 inches thick, TEFLON fiberglass cloth covering mounted on the rubber layer.

17 Claims, 8 Drawing Sheets

APPARATUS FOR APPLYING HEAT-TRANSFER LABELS ONTO OBJECTS

BACKGROUND OF THE INVENTION

The present invention relates generally to an apparatus for decorating articles and more particularly to an improved apparatus for applying heat-transfer labels onto objects.

Heat-transfer labels are well known in the art and are commonly applied onto objects, such as bottles, containers or other similar articles, to identify the particular product contained within the object.

Heat-transfer label assemblies are well known and widely used in the art. Heat-transfer label assemblies are typically manufactured as a continuous roll and commonly comprise a label-carrying continuous web (also commonly referred to simply as a carrier web), such as a polyethylene coated paper sheet, a release layer (also commonly referred to as a release mechanism), such as a wax release layer, affixed onto a surface of the carrier web and a heat-transfer label (also commonly referred to simply as a label), which is disposed on the wax release layer. The heat-transfer label typically comprises a protective layer affixed onto the wax release layer, an ink design layer affixed onto the protective layer and an adhesive layer affixed onto the ink design layer.

In U.S. Pat. No. 5,824,176 to S. H. Stein et al., which is hereby incorporated by reference, there is disclosed a composition for use in forming an adhesive layer and a heat-transfer label including such an adhesive layer. In one embodiment, the label is designed for use on silane-treated glass containers of the type that are subjected to pasteurization conditions. The label includes a support portion and a transfer portion, the transfer portion being positioned over the support portion. The support portion includes a sheet of paper overcoated with a release layer of polyethylene. The transfer portion includes an organic solvent-soluble phenoxy protective lacquer layer, an organic solvent-soluble polyester ink layer over the protective lacquer layer, and an acrylic adhesive layer over the ink layer. The adhesive layer is formed by depositing onto the ink layer, e.g., by gravure printing, a composition comprising a water-based acrylic resin dispersion or emulsion, isopropyl alcohol and water, and then evaporating the volatile components of the composition to leave an acrylic film.

Heat-transfer label decorators are well known and are commonly used in the art to apply heat-transfer labels onto objects.

Heat-transfer label decorators, also commonly referred to as decorator systems or decorators, typically comprise a turret for sequentially positioning the object at various application stations, a label transfer system for transferring a heat-transfer label from the continuous carrier web onto the desired article at a transfer station, a web transport assembly for sequentially positioning the labels on the carrier web at the transfer station and conveyors for feeding articles into the turret before labeling and for removing articles from the turret after labeling.

In use, heat-transfer label decorators typically function in the following manner. First, the web transport assembly disposes a portion of the supply roll of the heat-transfer label assembly against a preheating device, commonly in the form of an elongated, heated, metal platen. Disposing the heat-transfer label assembly against the preheating device causes the wax release layer to begin to melt and soften, thereby creating a weakened adhesion between the heat-transfer label and the paper sheet carrier web. After preheating a portion of the heat-transfer label assembly, the web transport assembly disposes the preheated heat-transfer label assembly against a label transfer system, commonly in the form of a heated rubber roller, the web transport assembly being synchronized with the turret so that a heat-transfer label from the preheated heat-transfer label assembly is positioned between the label transfer system and the article to be labeled. With the label positioned as such, the label transfer system further subjects the preheated heat-transfer label assembly to heat and presses the adhesive layer of the heat-transfer label into contact with the object. As the heat-transfer label assembly is subject to additional heat by the label transfer system, the wax layer continues to soften and melt and the adhesive layer becomes tacky, thereby allowing the heat-transfer label to transfer from the paper sheet carrier web and onto the desired object.

One type of heat transfer label decorator which is well known in the art is a continuous heat-transfer label decorator. A continuous heat-transfer label decorator is capable of decorating a continuous supply of objects at a variety of different speeds. As an example, a continuous heat-transfer label decorator is able to decorate a continuous supply of objects at a moderate, or normal, speed (approximately 50 containers per minute). As another example, a continuous heat-transfer label decorator is able to decorate a continuous supply of objects at a high speed (approximately 400 containers per minute). As can be appreciated, the turret of a continuous decorator advances a continuous supply of objects to the label transfer system for decoration without intermittently reducing the speed of the advancement of the object during the decoration process.

In U.S. Pat. No. 5,650,037 to M. G. Larson, there is disclosed a continuous, high speed, thermal ink transfer decorating apparatus, also commonly referred to as a heat transfer label decorator in the art. In the thermal ink transfer machine, the web is drawn translationally through a station at which thermal ink graphics are transferred from the web to the periphery of a container such as a glass or plastic bottle or can. Transfer of the graphics is effected with a transfer head or cylinder which has arranged about its axis of rotation a plurality of equally spaced apart radially spring biased rollers. When the longitudinally extending graphics on the web enters the transfer station, the spring biased rollers yield radially inwardly and outwardly to press against the backside of the web to effect transfer of the graphics. The apparatus has the rotating transfer head on one side of the web and the containers carried on a turntable on the opposite side of the web. The transfer head rotates in a particular direction around its vertical axis and drives the rollers orbitally toward and away from the graphics transfer station. The containers are supported on rotationally driven disks that are equally spaced apart on the turntable and bring the periphery of the containers into alignment with one of the spring biased rollers when graphics transfer is initiated where the leading end of the graphics make first contact with the container. The containers rotate in a direction opposite from the direction in which the turntable rotates. Thus the periphery of a container when in the transfer station moves in the same direction as the web. Means are provided for feeding web from an unwind reel to the transfer station and from the transfer station to a rewind reel. Means are also provided for maintaining equality in the length of web extending from the unwind reel to the transfer station and from the transfer station to the rewind reel. Means are also provided for maintaining constant tension in the web.

It has been found that continuous decorating apparati, such as the continuous, high speed, decorating apparatus described in U.S. Pat. No. 5,650,037 to M. G. Larson, experience notable advantages. First, the continuous advancement of the objects to be decorated creates a continuous chain of decoration. As a consequence, a relatively large number of objects can be decorated in a relatively short period of time (i.e., approximately 400 objects can be decorated per minute in high speed applications), thereby improving the overall productivity and efficiency of the apparatus.

Although well known and widely used in the art, continuous decorating apparati, such as of the type described in U.S. Pat. No. 5,650,037 to M. G. Larson, typically suffer from a notable drawback. Specifically, due to the continuous advancement of the objects during the decoration process, each object has a relatively short period of time in which the label transfer system disposes the heat-transfer label into contact thereto. In addition, in order to transfer a label around the entire periphery of an object, the object must be quickly rotated 360 degrees within the short period of decoration. Furthermore, because the advancement speed of the supply roll must always equal the rotational speed of the object, the supply roll of the heat-transfer label assembly must also be advanced at the same rapid rate in which the object rotates in order to enable the label to be transferred onto the desired object within the short period of contact. Accordingly, because the heat-transfer label assembly is fed at a relatively high rate, the duration of time in which the heat-transfer label assembly is subjected to the heat of the platen and the heat transfer system is significantly limited. As a result, it has been found that the heat-transfer label assembly is often inadequately heated, thereby precluding effective transfer of the heat-transfer label onto the desired object, which is highly undesirable.

SUMMARY OF THE INVENTION

It is an object of the present invention to provide a novel apparatus for applying heat-transfer labels onto objects.

It is another object of the present invention to provide an apparatus as described above which decorates a continuous supply of objects.

It is yet another object of the present invention to provide an apparatus as described above which effectively applies heat-transfer labels onto objects.

It is still another object of the present invention to provide an apparatus as described above which requires a limited number of parts, which is easy to use and which is inexpensive to manufacture.

Accordingly, there is provided an apparatus for applying the heat-transfer label of a heat-transfer label assembly onto an object, said apparatus comprising a decorating unit for applying the heat-transfer label onto the object during a period of decoration, said decorating unit comprising a heated contact plate which is disposed to continuously urge the heat-transfer label into contact with the object throughout the period of decoration, and a conveying mechanism for advancing and supporting the object throughout the period of decoration.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration a particular embodiment for practicing the invention. The embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate a particular embodiment of the invention and, together with the description, serve to explain the principles of the invention. In the drawings wherein like reference numerals represent like parts.

DETAILED DESCRIPTION OF A PREFERRED EMBODIMENT

Figure 1:
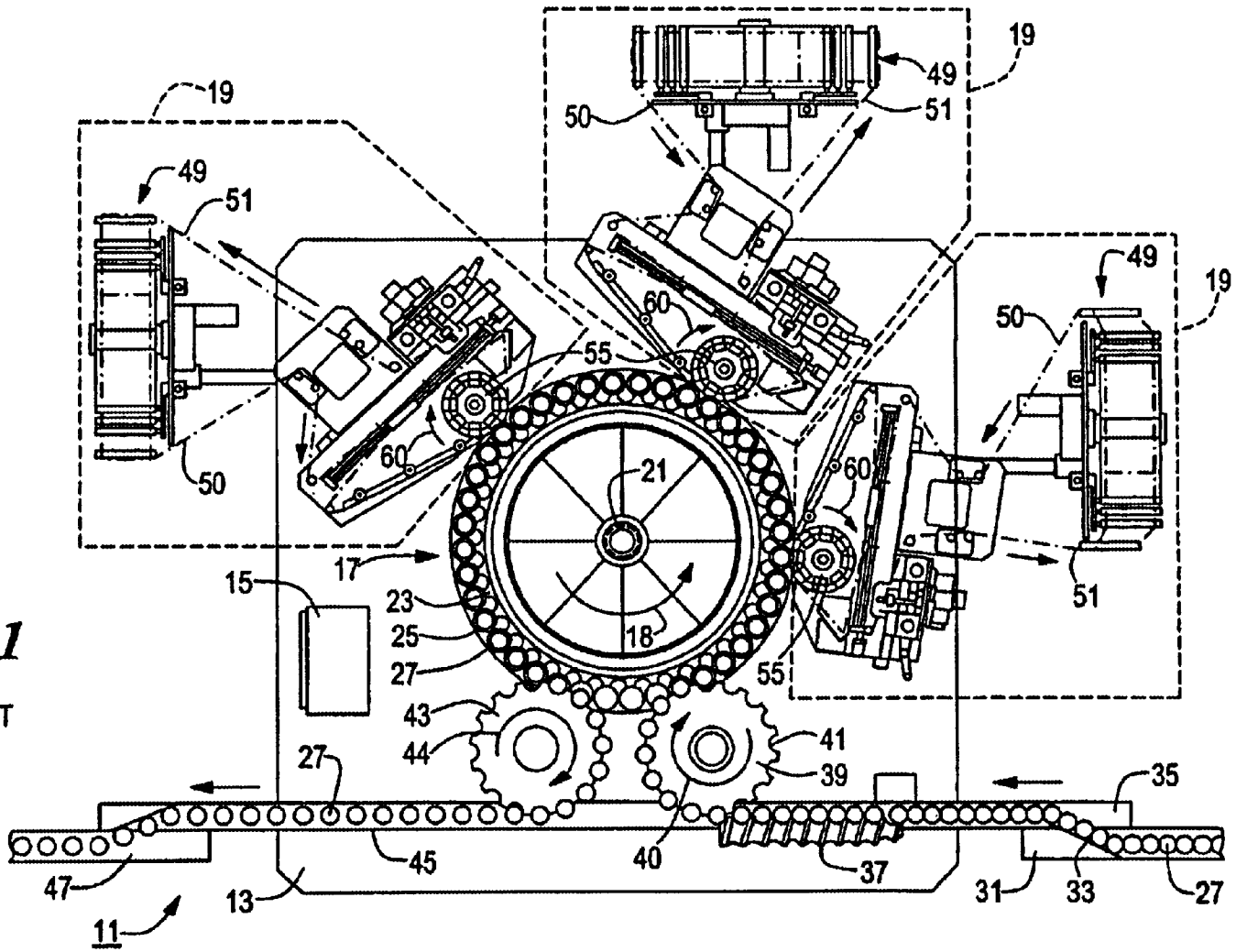
FIG. 1 PRIOR ART
FIG. 1 is a top plan view of a prior art thermal ink graphics transfer machine which has three separate graphics transferring or container decorating heads which can label or decorate the front back and neck of a container during one pass through the machine.

Referring now to FIG. 1, there is shown a prior art thermal ink transfer machine which is identified by reference numeral 11. As can be appreciated, prior art thermal ink transfer machine 11 is of the type disclosed in U.S. Pat. No. 5,650,037 to M. G. Larson, which is hereby incorporated by reference. For simplicity purposes only, selected components of conventional thermal ink transfer machine 11 which are not essential to understanding of the teachings of the present invention are not described in detail herein.

Machine 11 comprises a base 13, a computer station 15 mounted on base 13, a turntable 17 rotatably mounted on base 13 and a plurality of decorating units 19 positioned along the outer periphery of turntable 17.

Computer station 15 is represented generally as a rectangular box and preferably includes a programmable logic controller (PLC) for providing operator interface with machine 11.

Turntable 17 is adapted to be rotationally driven in a counterclockwise direction about a vertical shaft 21, as represented by arrow 18 in FIG. 1. Turntable 17 has a circular rim, or outer periphery, 23 on which are mounted a plurality of container support disks 25 which are equally spaced apart. Each container support disk 25 is adapted to be rotationally driven in a clockwise direction about its vertical axis, as represented by arrow 26 in FIG. 3.

It should be noted that machine 11 is shown as including forty, rotatably driven, container support discs 25. However, it is to be understood that machine 11 could include additional or fewer support discs 25 depending upon its use.

Figure 2:
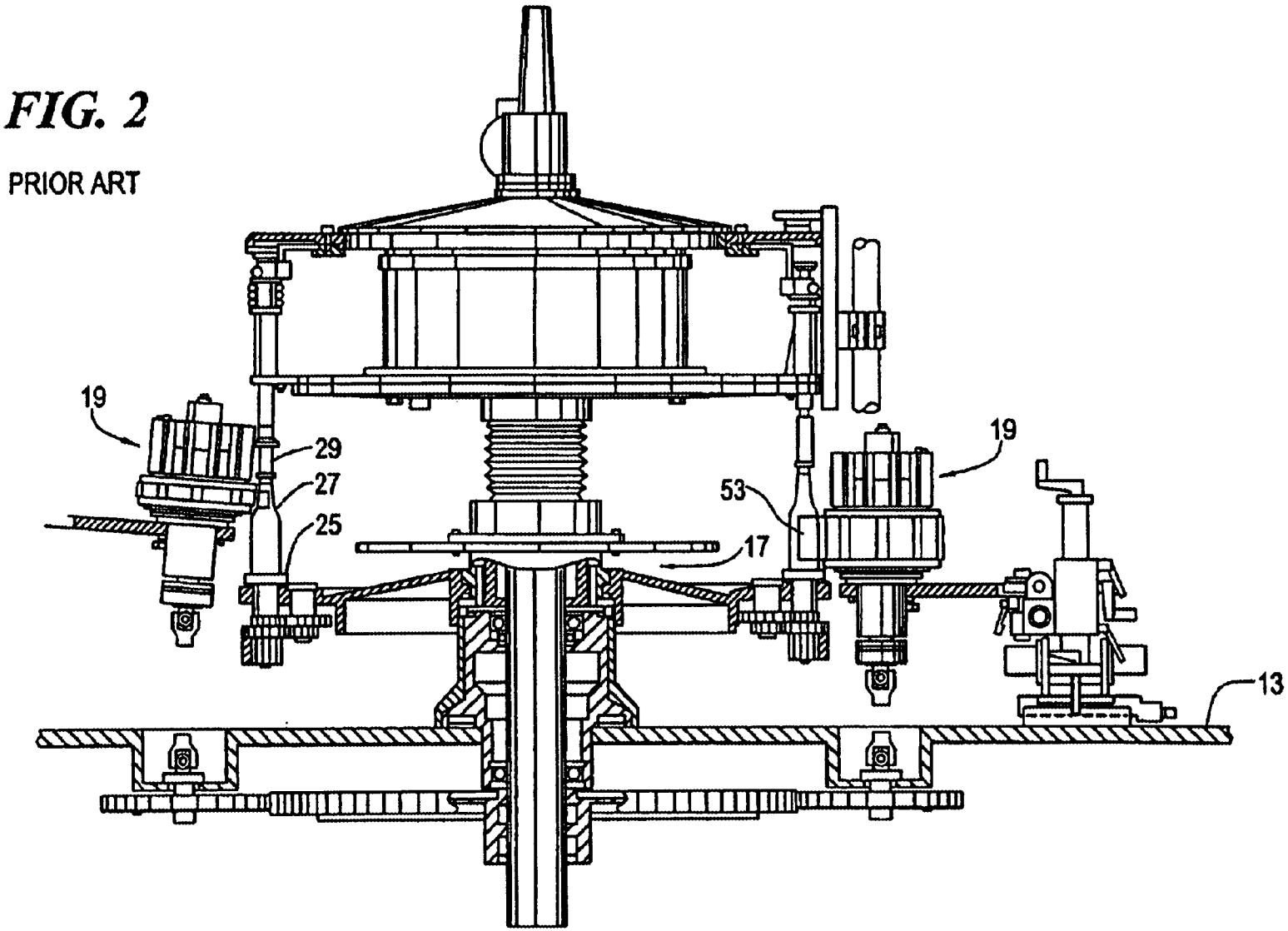
FIG. 2 PRIOR ART
FIG. 2 is a side elevational view of the turntable and the other associated parts of the prior art machine shown in FIG. 1.

Each disk 25 is adapted to receive an associated container 27, such as a plastic or glass bottle or metal can, which is fed into machine 11 for decoration. Once a disk 25 receives an associated container 27, a centering bell 29 projects down into the open mouth of container 27 to stabilize the container 27 on its associated support disk 25 during the decoration process, as shown in FIG. 2. Specifically, centering bell 29 stabilizes container 27 on its associated support disk 25 as disk 25 rotates in the clockwise direction. Furthermore, centering bell 29 stabilizes container 27 on its associated support disk 25 as turntable 17 rotates in the counterclockwise direction.

Containers 27 to be decorated by decorating units 19 are advanced onto turntable 17 by an infeed belt conveyor 31 which positions containers 27 in close relation to one another. A deflector 33 directs incoming containers 27 from infeed belt conveyor 31 to a second conveyor 35 which is translating slower than conveyor 31, conveyor 35 translating at a speed which positions consecutive containers 27 in a back-to-back relationship thereon.

An infeed worm 37 and an infeed starwheel 39 are positioned along conveyor 35. Infeed starwheel 39 is adapted to rotate in a clockwise direction, as represented by arrow 40 in FIG. 1, and is shaped to include a plurality of pockets 41 along its periphery. The pitch of infeed worm 37 is the same as the pitch of pockets 41 in infeed starwheel 39. As such, infeed starwheel 39 is rotatably driven in a clockwise direction at a constant speed which is in phase with the speed of rotation of turntable 17. In this manner, as containers 27 advance along on conveyor 35, each container 27 is individually captured by infeed worm 37 and is advanced into an associated pocket 41 in starwheel 39. In turn, starwheel 41, which is in rotatable synchronization with turntable 17, advances each container 27 onto an associated rotatable container support disk 25. Once an incoming container 27 is released from infeed starwheel 41 and is positioned upon an associated container support disk 25, centering bell 29 projects downward and into the mouth of the container 27 to support the container 27 during the decoration process.

Furthermore, after containers 27 on turntable 17 are decorated by decorating units 19, the decorated containers 27 are transferred consecutively from turntable 17 directly to an outfeed starwheel 43 which is adapted to rotate in a clockwise direction, as represented by arrow 44 in FIG. 1. Rotation of starwheel 44 discharges the decorated containers 27 to linear outfeed conveyor 45 which, in turn, discharges the decorated containers 27 to linear outfeed conveyor 47.

Decorating units 19 are disposed along the periphery of turntable 17 and serve to decorate containers 27 as containers 27 are driven at a continuous, high speed by turntable 17. Each decorating unit 19 comprises a web unwind and rewind system 49 which advances a plurality of heat-transfer label assemblies 50.

Heat-transfer label assemblies 50 are preferably manufactured as a continuous supply roll and represents any labeled web which is well known in the art. For example, supply roll of heat-transfer label assemblies 50 may be of the type disclosed in U.S. Pat. No. 5,824,176 to S. H. Stein et al, which is hereby incorporated by reference. The supply roll of heat-transfer label assemblies 50 preferably comprises a label-carrying continuous web, or carrier web, 51, such as a polyethylene coated paper sheet, a release layer (not shown), such as a wax release layer, affixed onto a surface of carrier web 51 and a plurality of heat-transfer labels, or labels, 53 which are disposed on the release layer.

Each decorating unit 19 further comprises an elongated heated platen 54 which preheats heat-transfer label assemblies 50 before label 53 is transferred onto container 27 and a thermal ink graphic transfer head 55 which further heats heat-transfer label assemblies 50 and disposes a label 53 in contact with an associated container 27 to execute the label transfer.

Platen 54 is constructed of a conductive material which is heated by temperature regulated electric heaters. Elongated platen 54 is disposed to contact heat-transfer label assemblies 50 with the side of carrier web 51 opposite label 53 bearing directly on platen 54. As such, platen 54 serves to warm, or preheat, heat-transfer label assemblies 50 sufficiently to enable heat-transfer label 53 to be transferred from carrier web 51 and onto container 27 by transfer head 55, as will be described further in detail below.

Figure 3:
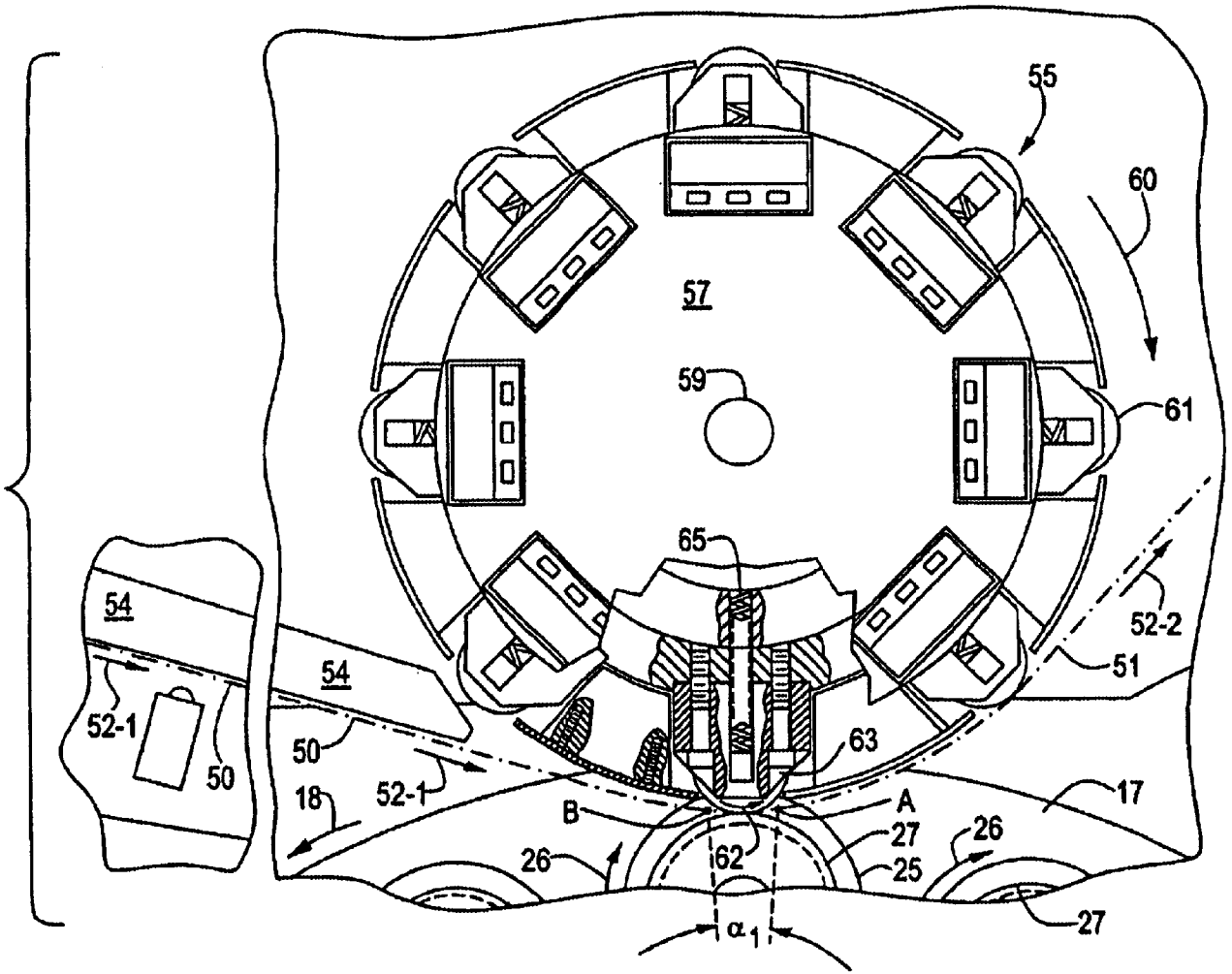
FIG. 3 PRIOR ART
FIG. 3 is a top plan view of the graphics transfer head shown in FIG. 1, a part of the graphics transfer head being broken away to show a spring biased roller that is operative to press the heat transfer label assembly against the periphery of a container on the turntable at the transfer station.

Transfer head 55 comprises a rotor 57 adapted to be rotationally driven about a vertical shaft 59 in a clockwise direction, as represented by arrow 60 in FIG. 3. Transfer head 55 also comprises a plurality of rubber rollers 61 which are equi-angularly spaced along the periphery of rotor 57. As will be described further in detail below, transfer head 55 is positioned such that heat-transfer label assemblies 50 are fed between rollers 61 and containers 27.

Each roller 61 is adapted to be rotationally driven about its vertical axis in a counterclockwise direction, as represented by arrow 62 in FIG. 3. Furthermore, each roller 61 is mounted on a slidable carriage 63 which is urged resiliently outward by a spring 65. As a consequence, each roller 61 is adapted to inwardly retract and outwardly displace so as to continuously draw an individual heat-transfer label 53 into contact against the periphery of associated container 27 during the period of label transfer.

In use, decorating units 19 decorate containers 27 in the following manner. With each container 27 positioned upon an associated support disk 25 and with an associated centering bell 29 disposed down into the open mouth of each container 27, support disks 25 continuously rotate containers 27 in the clockwise direction, as represented by arrow 26 in FIG. 3, and turntable 17 continuously rotates in the counterclockwise direction, as represented by arrow 18 in FIG. 3, so as to advance containers 27 to decorating units 19 for application of a label 53 thereon. At the same time, web unwind and rewind system 49 continuously advances a supply of heat-transfer label assemblies 50 between transfer head 55 and containers 27 at the same speed in which support disks 25 rotate containers 27.

It should be noted that system 49 advances the supply of heat-transfer label assemblies 50 in a left-to-right direction, as represented by arrows 52-1 in FIG. 3. As such, the supply of heat-transfer label assemblies 50 is advanced in the reverse direction in which turntable 17 rotates, as evidenced by the direction of arrows 18 and 52-1 in FIG. 3. As can be appreciated, reverse direction feeding of heat-transfer label assemblies 50 in relation to the rotation of turntable 17 is well known in the art and is commonly used in high speed label transfer applications.

With turntable 17 advancing containers 27 in a counterclockwise direction towards decorating units 19, turntable 17 and rotor 57 rotate in such as manner so that each container 27 is synchronized to align with an associated roller 61, as shown in FIG. 3. Specifically, with turntable 17 and rotor 57 rotating at the same speed but in opposite directions, a roller 61 which is disposed against the backside of heat-transfer label assembly 50 is synchronized to urge an individual label 53 against the outer periphery of an associated container 27 at a first point of contact A and continuously draw label 53 against individual container 27 until a final point of contact B, as shown in FIG. 3. The urging of label 53 into contact against the outer periphery of container 27 by roller 61 causes label 53 to transfer from web 51 and onto container 27. Once label 53 has been transferred off web 51, the spent, or used, carrier web 51 is further advanced by system 49 in a left-to-right direction, as represented by arrows 52-2.

It should be noted that, with roller 61 urging heat-transfer label 53 against container 27, the rotation of roller 61 in the counterclockwise direction and the rotation of support disk 25 in the clockwise direction transfers label 53 entirely around container 27. As can be appreciated, roller 61, support disk 25 and supply of heat-transfer label assemblies 50 all rotate very rapidly (approximately 360 degrees in approximately 0.2 seconds) in order to complete the transfer of label 53 around the entire periphery of container 27 within the relatively short period of contact between point of contact A and point of contact B.

It should be noted that although turntable 17 and transfer head 55 rotate in opposite directions the tangential or linear components of motion at decorating unit 19 where graphic transfer is occurring is the same. In addition, the peripheral surface of container 27 is moving in the same direction as heat-transfer labels 50 and roller 63, thereby creating a short, continuous period of label transfer. As noted above, the continuous period of label transfer begins at contact point A and continues until contact point B, thereby creating an total angle of contact $\equiv_1$ which is approximately 2 degrees, as shown in FIG. 3. The relatively small angle of contact $\equiv_1$ creates a period of label transfer from contact period A to contact period B which is considerably brief (approximately ⅙ of a second).

As can be appreciated, prior art machine 11 suffers from a notable drawback. Specifically, as noted above, in order to transfer a heat-transfer label 53 from carrier web 51 and around the entire periphery of container 27, container 27 must be quickly rotated 360 degrees within the relatively short angle of contact $\equiv_1$. Because continuous supply of heat-transfer label assemblies 50 is fed at the same speed in which support disk 25 rotates container 27, the quick rotation of support disk 25 necessitates that the supply of heat-transfer label assemblies 50 be fed at the same high speed. It should be noted that because the supply of heat-transfer label assemblies 50 is fed at a relatively high speed, the duration of time in which the supply of heat-transfer label assemblies 50 is contacted against heated roller 61 is significantly limited. Accordingly, as a result of the limited contact time of the supply of heat-transfer label assemblies 50 against roller 61, it has been found that the supply of heat-transfer label assemblies 50 is often inadequately heated. Inadequate heating of heat-transfer label assemblies 50 can significantly compromise the effectiveness of the transfer of heat-transfer label 53 onto the container 27, which is highly undesirable. Specifically, inadequate heating of the supply of heat-transfer label assemblies 50 can compromise the quality of the visual components (i.e., the smoothness and aesthetics) of heat-transfer label 53 upon transfer onto container 27. In addition, inadequate heating of the supply of heat-transfer label assemblies 50 can compromise the functionality, or performance, of the transfer of heat-transfer label 53 onto container 27.

Figure 4:
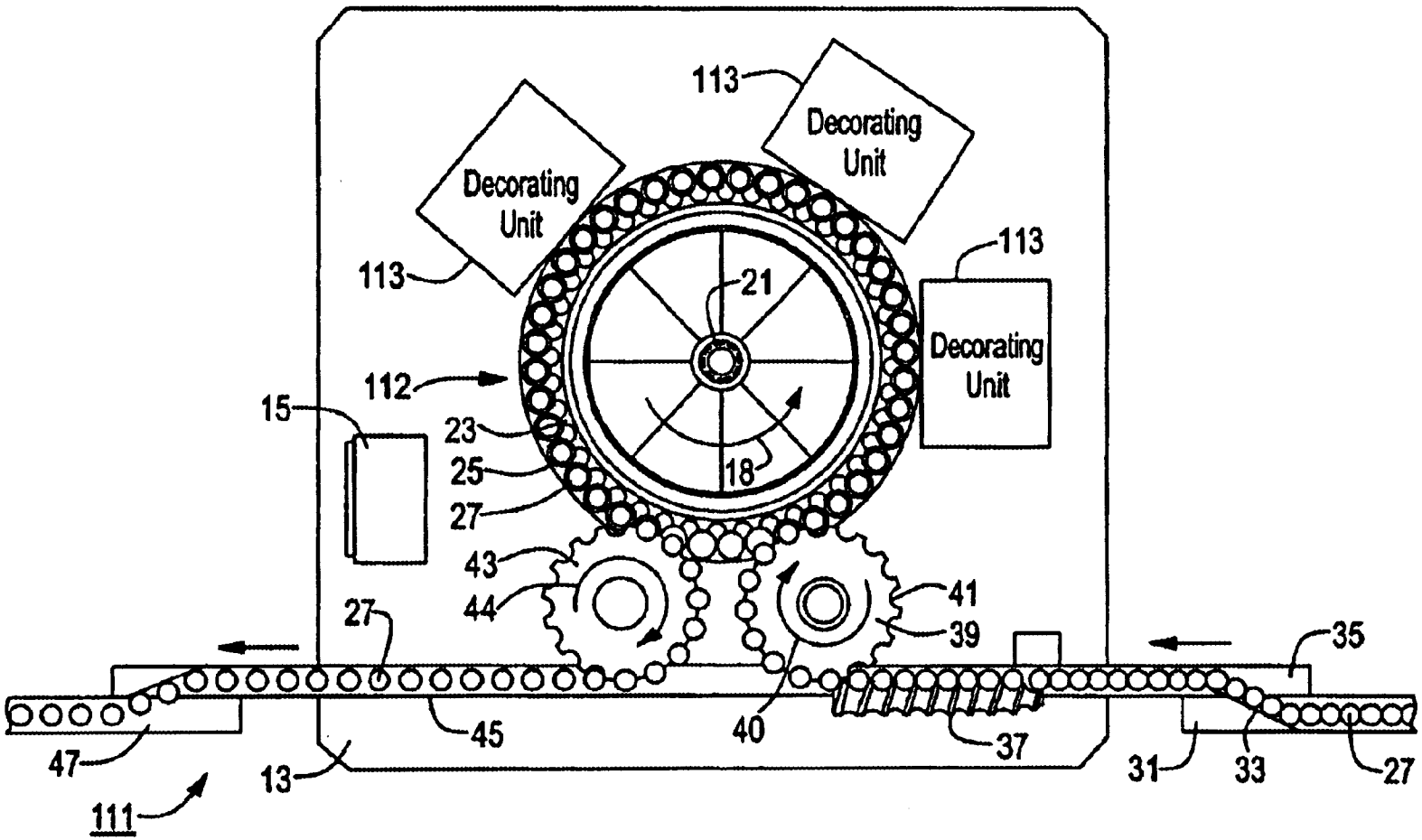
FIG. 4 is a top plan view of an apparatus constructed according to the teachings of the present invention for applying heat-transfer labels which has three separate decorating units.

Accordingly, FIG. 4 shows an apparatus constructed according to the teachings of the present invention for applying heat-transfer labels onto containers, the apparatus being identified generally by reference numeral 111. As will be described further in detail below, apparatus 111 utilizes a significantly longer period of label transfer contact and, as a result, more effectively transfers labels 53 from web 51 onto containers 27 than machine 11, which is a principal object of the present invention.

Apparatus 111 is similar to machine 11 in that apparatus 111 comprises base 13, computer station 15 mounted on base 13 and a conveying mechanism 112 mounted on base 13. It should be noted that conveying mechanism 112 is shown as being identical to turntable 17 of machine 11. However, it is to be understood that conveying mechanism 112 is not limited to a turntable which is rotatably mounted on base 13. Rather, conveying mechanism 112 could be in the form of alternative conveyors, such as a linear feed conveyor, without departing from the spirit of the present invention.

Apparatus 111 differs from machine 11 only in that apparatus 111 comprises a plurality of decorating units 113 positioned along the outer periphery of conveying mechanism 112 which differ in construction from decorating units 19 of machine 11. It should be noted that the novelty of the present invention pertains to the particular construction of decorating units113.

Since the novelty of apparatus 111 pertains solely to decorating units 113, it is to be understood that the components of apparatus 111 other than decoration units 113 could be removed and/or replaced with similar components found in other prior art decoration machines without departing from the spirit of the present invention.

Apparatus 111 is shown comprising three identical decorating units 113. However, it is to be understood that the novelty of the present invention pertains to the particular construction of decorating units 113 and not to the number of decorating units 113. As a result, the number of decorating units 113 in apparatus 111 could be increased or decreased without departing from the spirit of the present invention.

Figure 5:
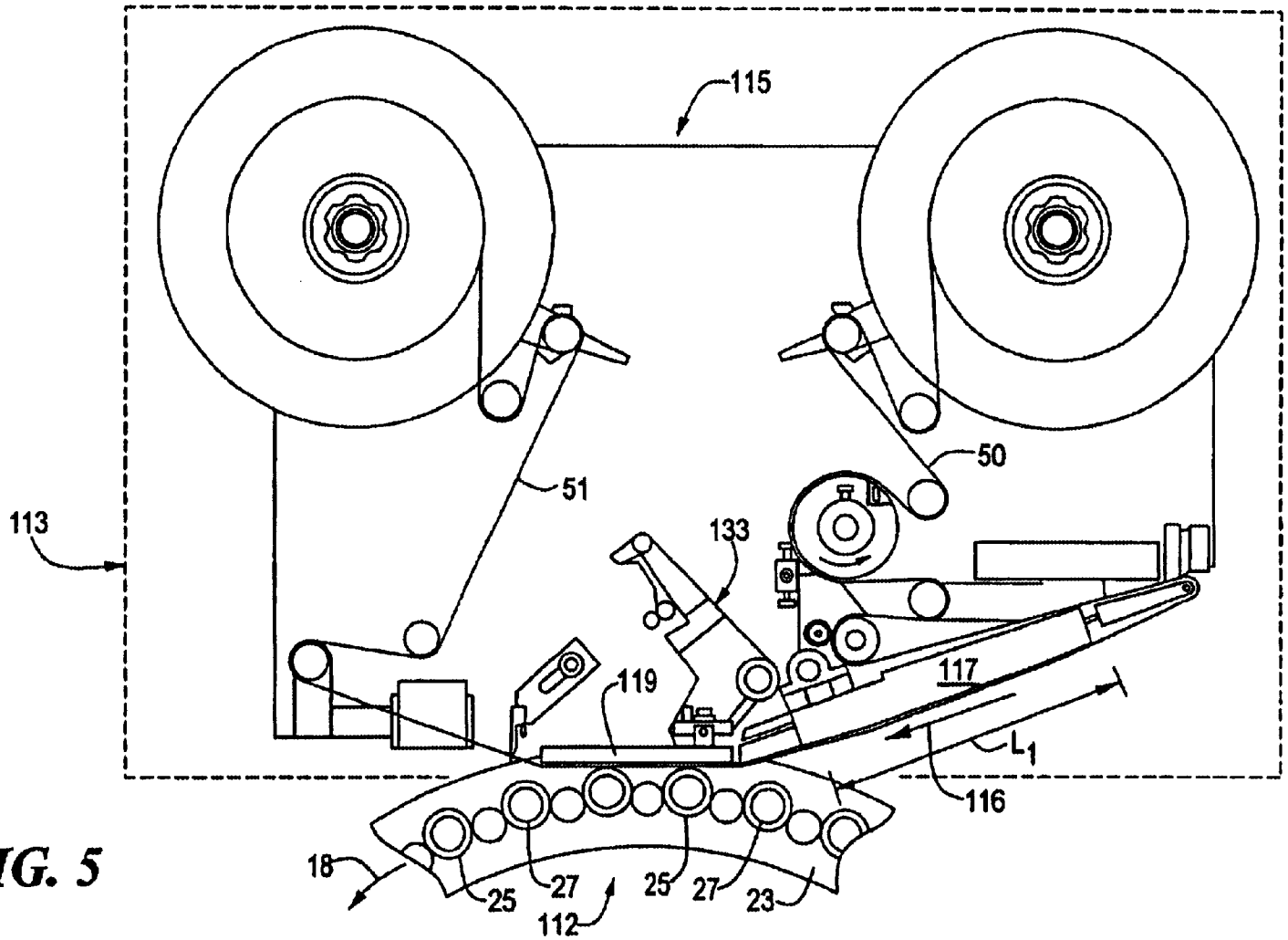
FIG. 5 is an enlarged top plan view of one of the decorating units shown in FIG. 4, the decorating unit being shown in relation to the conveying mechanism and a plurality of containers.

Referring now to FIG. 5, each decorating unit 113 comprises a web transport assembly 115, an elongated preheater 117 for preheating the continuous supply roll of heat-transfer label assemblies 50 and a contact plate 119 for transferring heat-transfer labels 53 from continuous carrier web 51 onto containers 27. Contact plate 119 is shown as being flat. However, it is to be understood that contact plate 119 is not limited to be flat. Rather, contact plate 119 could alternatively be angled or bowed without departing from the spirit of the present invention.

Web transport assembly 115 serves to position labels 53 on carrier web 51 directly onto contact plate 119 in synchronization with conveying mechanism 112 so that successive labels 53 are properly aligned with successive containers 27.

It should be noted that the particular construction of web transport assembly 115 does not serve as a feature of the present invention. Accordingly, the details of the components of web transport assembly 115 are not disclosed herein. Furthermore, because web transport assembly 115 is not considered a feature of the present invention, web transport assembly 115 could be replaced with alternative prior art web transport assemblies without departing from the spirit of the present invention.

Elongated preheater 117 has a length $L_1$ of approximately 16 inches and is preferably heated to a temperature of approximately 250 degrees Fahrenheit. Elongated preheater 117 is positioned to contact the surface of carrier web 51 opposite label 53. As such, elongated preheater 117 causes the wax release layer (not shown) between carrier web 51 and heat-transfer label 53 to begin to soften, thereby creating a weakened adhesion between heat-transfer label 53 and the paper sheet carrier web 51. Preferably, web transport assembly 115 disposes the supply roll of heat-transfer label assemblies 50 in contact against a portion of both sides of preheater 117, as shown in FIG. 5, thereby increasing the total length of contact between heat-transfer label assemblies 50 and preheater 117 to approximately 19 inches.

Elongated contact plate 119 is preferably heated to a temperature of approximately 450 degrees Fahrenheit and is positioned to contact the surface of elongated carrier web 51 opposite label 53. As will be described further in detail below, conveying mechanism 112 supports and advances container 27 in the counterclockwise direction, as represented by arrow 18 in FIG. 5, throughout the period of decoration. The rotation of conveying mechanism 112 in the counterclockwise direction draws each container 27 against an associated heat-transfer label 53 which, in turn, is disposed against contact plate 119. Specifically, container 27 is disposed against heat-transfer label 53, which is positioned against plate 119, for a continuous period of contact from a primary point of contact C to a final point of contact D, the length $L_2$ of the arcuate path of continuous contact from point C to point D being approximately 4 inches and the total angle of contact $\equiv_2$ between contact point C and contact point D being approximately 10 degrees, as shown in FIG. 6.

Figure 6:
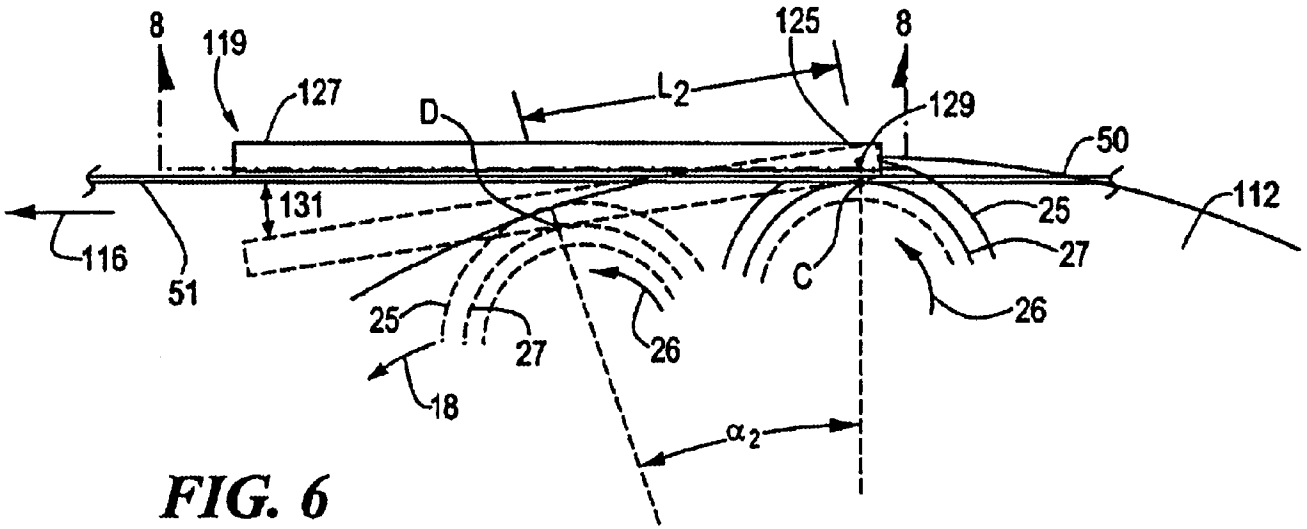
FIG. 6 is an enlarged, fragmentary, top plan view of the contact plate and the heat-transfer label assembly shown in FIG. 5, the contact plate being shown with a container in contact therewith at the primary point of label transfer contact, the contact plate also being shown in dashed lines with a container, also shown in dashed lines, in contact therewith at the final point of label transfer contact.

During the continuous period of contact between heat-transfer label 53 and container 27, support disk 25 on which container 27 is mounted rotates in a counterclockwise direction, as represented by arrows 26 in FIG. 6, at a speed which enables container 27 to make one complete revolution between point C and point D and at a speed which is preferably equal to the speed in which web transport assembly 115 advances the supply roll of heat-transfer label assemblies 50.

Figure 8:
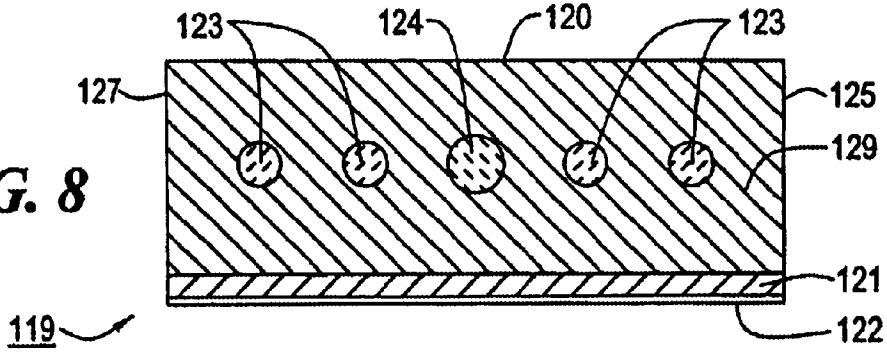
FIG. 8 is an enlarged, top section view, taken along lines 8-8, of the contact plate shown in FIG. 6.
Figure 7A:
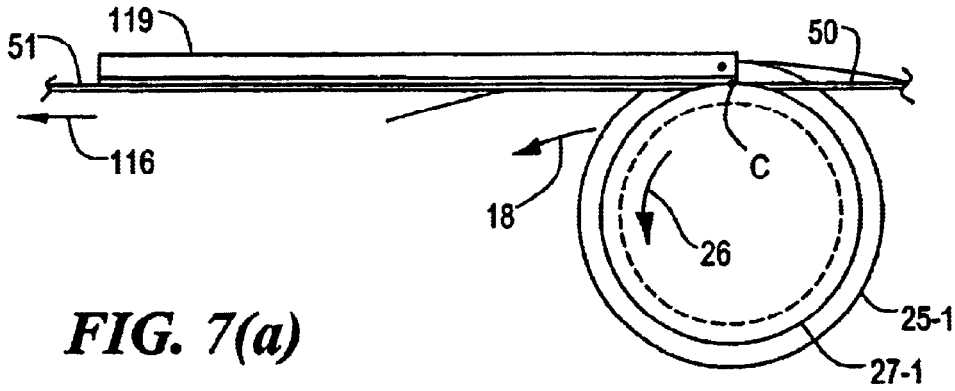
FIGS. 7(*a*)–(*e*) are enlarged, fragmentary, top plan views of the contact plate and the heat-transfer label assembly shown in FIG. 5, the contact plate being shown with a container positioned relative thereto at various stages during the decoration process of the container.
Figure 7B:
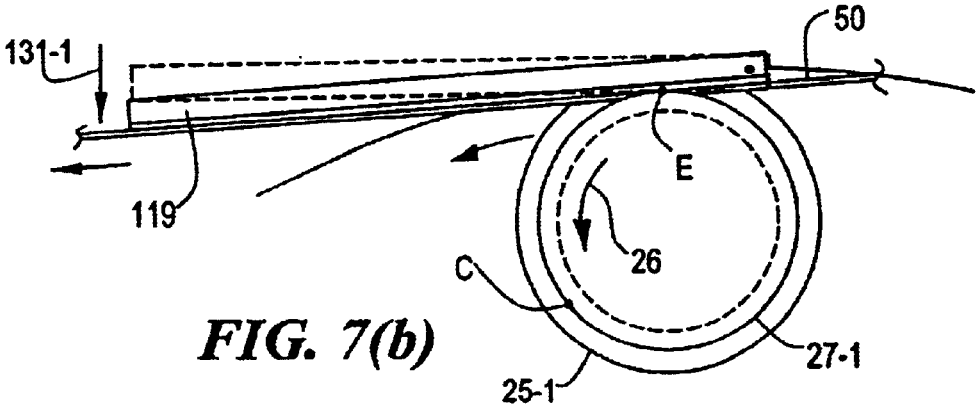
Figure 7C:
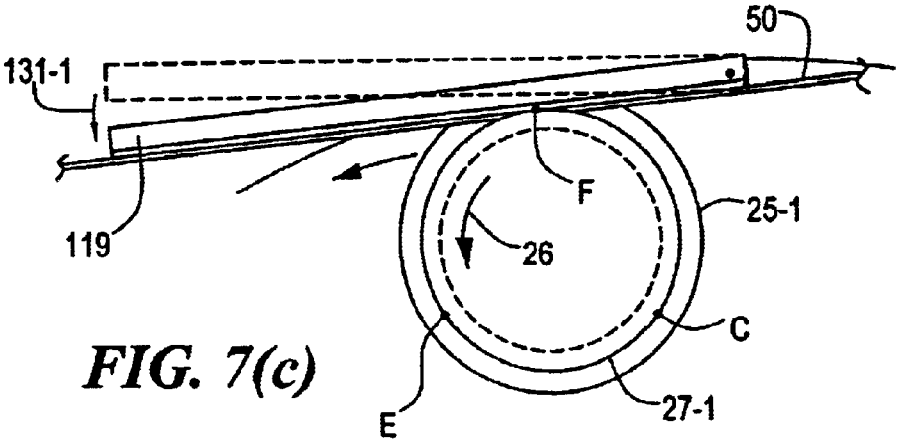
Figure 7D:
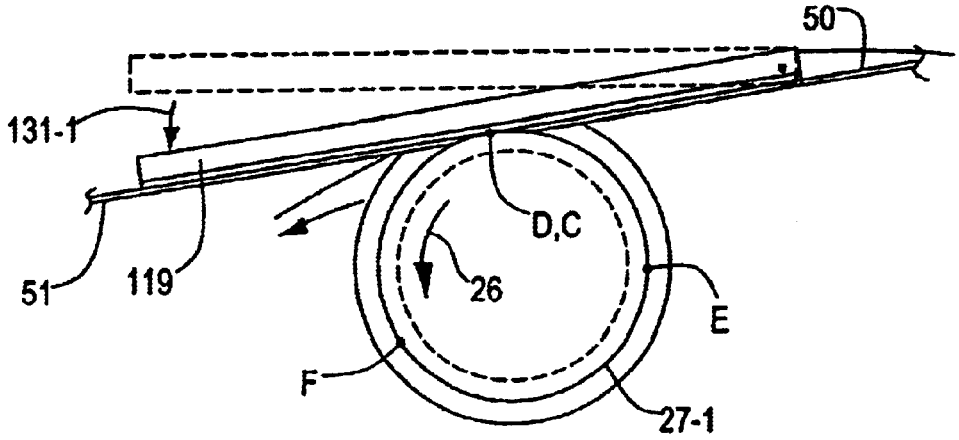
Figure 7E:
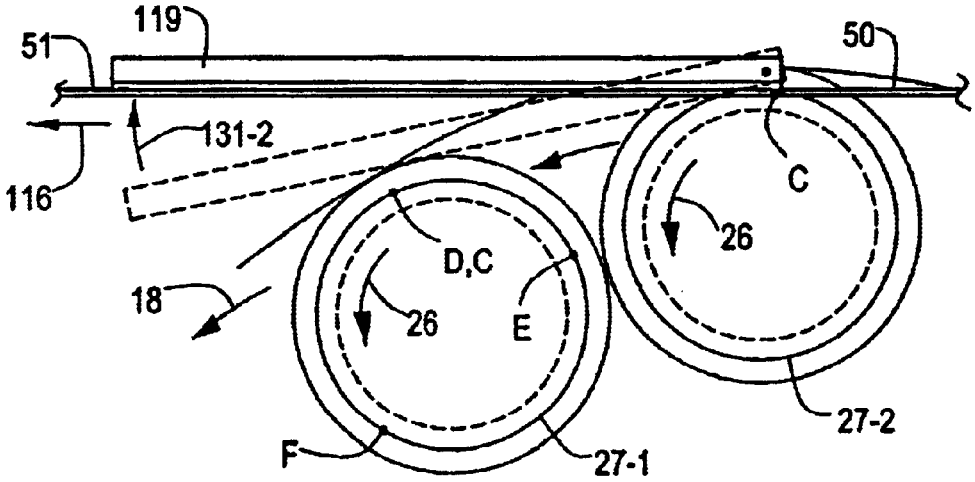

Referring now to FIG. 8, contact plate 119 comprises an aluminum heating plate 120, a rubber layer 121 mounted on heating plate 120 and a covering 122 disposed over rubber layer 121. A plurality of heating cartridges 123 are disposed in heating plate 120 and serve to raise the temperature of plate 120. In addition, a temperature sensing probe 124 is disposed in heating plate 120 and serves to monitor the temperature of plate 120. Rubber layer 121 is preferably constructed of an 80 durometer silicone and is thermally coupled onto plate 120 such that rubber layer 121 changes in temperature as plate 120 changes in temperature. Covering 122 is constructed of a relatively thin and slick material, such as a 0.10 inches thick layer of TEFLON polytetrafluorethylene fiberglass cloth.

Contact plate 119 is disposed such that the surface of carrier web 51 opposite label 53 contacts covering 122. It should be noted that, due to the slick nature of covering 122, as web transport assembly 115 advances the continuous supply of heat-transfer label assemblies 50 in a right-to-left direction, as represented by arrow 116 in FIG. 5, carrier web 51 of heat-transfer label assemblies 50 slides easily on covering 122, thereby preventing carrier web 51 from catching, pinching and/or tearing on covering 122 during the contact period of decoration. Furthermore, it should be noted that support disks 25 intentionally rotate containers 27 in the same linear direction in which transport assembly 115 advances the continuous supply of heat-transfer label assemblies 50, as evidenced by arrows 26 and 116 in FIG. 6, so as to prevent carrier web 51 from catching, pinching and/or tearing on covering 122 during the contact period of decoration.

Although the supply roll of heat-transfer label assemblies 50 is shown as being advanced in a right-to-left direction, as shown by arrow 116 in FIG. 5, and in the same linear direction in which conveying mechanism 112 rotates, as shown by arrow 18 in FIG. 5, it should be noted that conveying mechanism 112 could alternatively be constructed to rotate in a clockwise direction without departing from the spirit of the present invention. As can be appreciated, constructing conveying mechanism 112 to rotate in the opposite linear direction in which the supply roll of heat-transfer label assemblies 50 is advanced would enable apparatus 111 to decorate at high speeds (i.e., 400 containers per minute).

Contact plate 119 includes a first end 125 and a second end 127. Contact plate 119 is adapted to be pivoted about a pivot point 129 proximate first end 125 in opposing directions, as represented by arrow 131 in FIG. 6. It should be noted that pivot point 129 is not limited to being located proximate first end 125 but rather could be moved to alternative positions along contact plate 119 without departing from the spirit of the present invention. A pivot mechanism 133, such as a piston, is fixedly coupled to plate 120. As such, pivot mechanism 133 pivots contact plate 119 in order to maintain contact between contact plate 119 and container 27 during the decoration process as container 27 continuously travels along the arc in which conveying mechanism 112 travels.

In use, decorating units 113 apply a beat-transfer label 53 from carrier web 51 onto container 27 in the following manner. With each container 27 positioned upon an associated support disk 25 and with an associated centering bell 29 disposed down into the open mouth of each container 27, conveying mechanism 112 continuously rotates in the counterclockwise direction so as to advance containers 27 to decorating units 113 for application of a label 53 thereon, the continuous supply roll of heat-transfer label assemblies 50 being advanced between contact plate 119 and containers 27 in a right-to-left direction, as shown by arrow 116 in FIG. 5.

With conveying mechanism 112 advancing containers 27 in a counterclockwise arcuate path, as represented by arrow 18, towards decorating units 113, contact plate 119 is disposed in a rearward position, as represented by solid lines in FIG. 6. Conveying mechanism 112 advances a first container 27-1 against an individual heat-transfer label assembly 50, which is positioned against contact plate 119, at primary point of contact C, as shown in FIG. 7(*a*). It should be noted that web transport assembly 115 is in synchronization with conveying mechanism 112 in such a manner that the leading edge of individual label 53 is aligned to contact container 27-1 at primary point of contact C. The heat of contact plate 119 and the contact of container 27-1 against heat-transfer label assembly 50 serves to begin the transfer of heat-transfer label 53 from web 51 and onto container 27-1.

As conveying mechanism 112 continues to advance container 27-1 in the counterclockwise direction, contact plate 119 similarly pivots in the counterclockwise direction, as represented by arrow 131-1 in FIG. 7(*b*), so as to continuously draw label 53 into contact against container 27-1 during the entire period of decoration. FIGS. 7(*b*) and 7(*c*) show plate 119 pressing label 53 against container 27-1 at a first intermediate point of contact E and a second intermediate point of contact F, respectively.

Contact plate 119 continues to draw label 53 against container 27-1 until final point of contact D, container 27-1 making one complete revolution so that primary point of contact C and final point of contact D occur on the same point on container 27-1, thereby completing decoration of container 27-1. It should be noted that the continuous supply roll of heat transfer label assemblies 50 is advanced in the same linear direction and at the same speed in which support disk 25 rotates container 27 so as to complete decoration of the entire periphery of container 27-1 within the period of decoration.

At final point of contact D, contact plate 119 is disposed in a forward position, as represented by solid lines in FIG. 7(*d*). Upon completion of decorating container 27-1, plate 119 pivots in a clockwise direction, as represented by arrow 131-2 in FIG. 7(*e*), and back to its rearward position, as shown by solid lines in FIG. 7(*e*). Continuously, conveying mechanism 112 advances first container 27-1 away from contact plate 119 and advances a second container 27-2 against a heat-transfer label assembly 50 which is disposed against contact plate 119, and the decoration process repeats for container 27-2.

As can be appreciated, the duration of the contact period in which label transfer is executed is considerably longer for apparatus 111 than machine 11. In fact, the duration of label transfer for apparatus 111 is over five times longer than the duration of label transfer for machine 11. The larger contact period for apparatus 111 can be attributed to the implementation of the elongated flat contact surface of plate 119 rather than the curved contact surface of roller 61 used in machine 11.

It should be noted that, as a result of its significantly longer contact period, apparatus 111 can perform the label transfer process over a longer period of time. Because the label transfer process is extended over a longer period of time, the rate in which continuous supply roll of heat-transfer label assemblies 50 is advanced and the rate in which support disk 25 rotates can be significantly reduced. The reduction in the rate in which heat-transfer label assemblies 50 are advanced allows heat-transfer label assemblies 50 to be heated over a longer period of time, thereby ensuring proper label transfer, which is a principal object of the present invention. Accordingly, it has been found that apparatus 111 is capable of highly effective continuous decoration, which is highly desirable.

The embodiment of the present invention described above is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. An apparatus for applying the heat-transfer label of a heat-transfer label assembly onto an object, said apparatus comprising:

a. a decorating unit for applying the heat-transfer label onto the object, said decorating unit comprising a heated contact plate which includes an elongated flat contact surface, said heated contact plate being adapted to pivot between a first position and a second position during the period of label transfers, the elongated, flat contact surface of the heated contact plate continuously urging the heat-transfer label into contact with the object throughout the period of label transfer; and b. a conveying mechanism for advancing the object along an arcuate path during the period of label transfer;

c. said contact plate extending tangential to the arcuate path when disposed in its first position of label transfer.

2. The apparatus of claim 1 wherein the contact plate comprises a heating plate and a rubber layer mounted on said heating plate.

3. The apparatus of claim 2 wherein the rubber layer which is constructed of an 80 durometer silicone.

4. The apparatus of claim 3 wherein the heated contact plate includes a covering mounted on the rubber layer, the covering being constructed of a 0.10 inches thick layer of Polytetrafluoroethylene fiberglass cloth.

5. The apparatus of claim 4 wherein said heated contact plate is heated to a temperature of approximately 450 degrees Fahrenheit.

6. The apparatus of claim 5 wherein said decorating unit further comprises an elongated heated preheater for heating the heat-transfer label before label transfer.

7. The apparatus of claim 6 wherein said conveying mechanism is in the form of a turntable which is continuously rotationally driven about a vertical axis.

8. The apparatus of claim 7 further comprising a plurality of support disks mounted on conveying mechanism, each of said plurality of support disks being sized and shaped to support and object.

9. The apparatus of claim 8 wherein each of the plurality of support disks is shaped to rotate relative to said conveying mechanism.

10. A decorating unit for applying the heat-transfer label of a heat-transfer label assembly onto an object, said decorating unit comprising:

a. a preheater for heating the heat-transfer label assembly before label transfer;

b. a heated contact plate which includes an elongated, flat contact surface, said heated contact plate being adapted to pivot between a first position and a second position during the period of label transfer, the elongated, flat contact surface of the heated contact plate continuously urging the heat-transfer label into contact with the object throughout the period of label transfer, the object traveling along an arcuate path throughout the period of label transfer, said contact plate extending tangential to the arcuate path when disposed in its first position of label transfer; and c. a transport assembly for advancing the heat-transfer label assembly from said preheater to said heated contact plate.

11. The decorating unit of claim 10 wherein said heated contact plate includes a rubber layer which is constructed of an 80 durometer silicone.

12. The decorating unit of claim 11 wherein said heated contact plate includes a covering mounted on the rubber layer, the covering being constructed of a 0.10 inches thick layer of Polytetrafluoroethylene fiberglass cloth.

13. The decorating unit of claim 12 wherein said heated contact plate is heated to a temperature of approximately 450 degrees Fahrenheit.

14. An apparatus for applying the transfer label of a transfer label assembly onto an object, said apparatus comprising:

a. a decorating unit for applying the label onto the object, said decorating unit comprising a contact plate which includes an elongated, flat contact surface, said contact plate including a pivot point, said pivot point being located within said contact plate, said contact plate being adapted to pivot about said pivot point between a first position and a second position during the period of label transfer, the elongated, flat contact surface of the contact plate continuously urging the transfer label into contact with the object throughout the period of label transfer; and b. a conveying mechanism for advancing the object along an arcuate path during the period of label transfer;

c. said contact plate extending tangential to the arcuate path when disposed in its first position of label transfer.

15. The apparatus of claim 1 wherein the heated contact plate includes a pivot point, said pivot point being located within said contact plate, said heated contact plate being adapted to pivot about said pivot point.

16. The decorating unit of claim 10 wherein the heated contact plate includes a pivot point, said pivot point being located within said contact plate, said heated contact plate being adapted to pivot about said pivot point.

17. An apparatus for applying the transfer label of a transfer label assembly onto an object, said apparatus comprising:

a. a decorating unit for applying the label onto the object, said decorating unit comprising a contact plate which includes an elongated contact surface, said contact plate being adapted to pivot between a first position and a second position during the period of label transfer, the elongated contact surface of the contact plate continuously urging the transfer label into contact with the object throughout the period of label transfer; and b. a conveying mechanism for advancing the object along an arcuate path during the period of label transfer;

c. said contact plate extending substantially tangential to the arcuate path when disposed in its first position of label transfer.

* * * * *

UNITED STATES PATENT AND TRADEMARK OFFICE

CERTIFICATE OF CORRECTION

PATENT NO. : 6,796,352 B1
DATED : September 28, 2004
INVENTOR(S) : John W. Geurtsen et al.

It is certified that error appears in the above-identified patent and that said Letters Patent is hereby corrected as shown below:

Title page,
Item [57], ABSTRACT,
Line 4, "decoration a conveying" should be -- decoration and a conveying --.
Line 15, "0.10 inches" should be -- 0.10 inch --.

Column 2,
Line 43, "enters" should be -- enter --.

Column 3,
Line 17, "thereto" should be -- therewith --.

Column 4,
Line 19, "front back" should be -- front, back --.
Line 50, "lines" should be -- line --.

Column 6,
Line 6, "represents" should be -- represent --.

Column 7,
Line 10, "in such as" should be -- in such a --.
Lines 46, 47 and 56, "-1" should be -- $\propto_1$ --.

Column 8,
Line 38, "units113" should be -- units 113 --.

Column 9,
Line 40, "-1" should be -- $\propto_1$ --.
Line 64, "0.10 inches" should be -- 0.10 inch --.

Column 10,
Line 43, "beat" should be -- heat --.

UNITED STATES PATENT AND TRADEMARK OFFICE

CERTIFICATE OF CORRECTION

PATENT NO. : 6,796,352 B1 
DATED : September 28, 2004
INVENTOR(S) : John W. Geurtsen et al.

It is certified that error appears in the above-identified patent and that said Letters Patent is hereby corrected as shown below:

Column 12,
Line 6, "transfers" should be -- transfer --.
Line 18, "layer which is" should be -- layer is --.
Line 21, "0.10 inches" should be -- 0.10 inch --.
Line 35, "support and object" should be -- support an object --.
Line 37, "disks is shaped" should be -- disks is adapted --.
Line 63, "0.10 inches" should be -- 0.10 inch --.

Signed and Sealed this

Twelfth Day of July, 2005

JON W. DUDAS
*Director of the United States Patent and Trademark Office*

UNITED STATES PATENT AND TRADEMARK OFFICE

CERTIFICATE OF CORRECTION

PATENT NO. : 6,796,352 B1
APPLICATION NO. : 09/634204
DATED : September 28, 2004
INVENTOR(S) : John W. Geurtsen et al.

It is certified that error appears in the above-identified patent and that said Letters Patent is hereby corrected as shown below:

On the title page item [73], insert MCC-Dec Tech, LLC

Signed and Sealed this

Fourteenth Day of August, 2007

JON W. DUDAS
*Director of the United States Patent and Trademark Office*